US007701394B2

(12) United States Patent
Hook et al.

(10) Patent No.: US 7,701,394 B2
(45) Date of Patent: Apr. 20, 2010

(54) PATCH ANTENNA

(75) Inventors: Anders Hook, Hindas (SE); Jessica Westerberg, Gothenburg (SE); Joakim Johansson, Tollsjo (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 229 days.

(21) Appl. No.: 11/569,011

(22) PCT Filed: Jun. 10, 2004

(86) PCT No.: PCT/SE2004/000918

§ 371 (c)(1),
(2), (4) Date: Nov. 13, 2006

(87) PCT Pub. No.: WO2005/122330

PCT Pub. Date: Dec. 22, 2005

(65) Prior Publication Data

US 2008/0012770 A1 Jan. 17, 2008

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 21/00*** | (2006.01) |

(52) U.S. Cl. ..... 343/700 MS; 343/893; 343/725

(58) Field of Classification Search ..... 343/700 MS, 343/893, 725, 824, 826
See application file for complete search history.

(56) References Cited

U.S. PATENT DOCUMENTS 5,229,777 A * 7/1993 Doyle ..... 343/700 MS
6,597,316 B2 7/2003 Rao
6,816,118 B2 * 11/2004 Kingsley et al. ..... 343/700 MS
6,989,794 B2 * 1/2006 Tran ..... 343/702
7,209,080 B2 * 4/2007 Crouch et al. ..... 343/700 MS
2003/0184478 A1 * 10/2003 Kingsley et al. ..... 343/700 MS
2003/0197647 A1 * 10/2003 Waterman ..... 343/700 MS
2004/0155817 A1 * 8/2004 Kingsley et al. ..... 343/700 MS
2006/0007044 A1 * 1/2006 Crouch et al. ..... 343/700 MS

FOREIGN PATENT DOCUMENTS

GB 2140974 A * 12/1984

OTHER PUBLICATIONS

S.P. Kingsley and S.G. O'Keefe, "Beam steering and monopulse processing of probe-fed dielectric resonator antennas," IEE Proc-Radar, Sonar Navig., vol. 146, No. 3, Jun. 1999.*

(Continued)

*Primary Examiner*—Douglas W Owens
*Assistant Examiner*—Jennifer F Hu
(74) *Attorney, Agent, or Firm*—Roger S. Burleigh

(57) ABSTRACT

A self-complementary patch antenna is disclosed. A hexagonal lattice (10) consisting of triangular conducting patches (1) is formed together with at least one dielectric layer onto a ground-plane. Each triangular patch is then fed by means of three RF signal probes in a symmetrical configuration positioned near each corner of the triangle, whereby an arbitrary lobe-steering and polarization state can be established by selection of amplitude and phase for each RF signal probe.

10 Claims, 3 Drawing Sheets

OTHER PUBLICATIONS

Written Opinion of the International Searching Authority for application PCT/SE 2004/000918, Jan. 20, 2005.*

Hing Kiu Kan, et al; "A Small CP-Printed Antenna Using 120° Sequential Rotation" IEEE Transactions on antennas and propagation vol. 50, No. 3, Mar. 2002, p. 398-399, ISSN 0018-926X.

PS Hall et al; "Design principles of sequentially fed, wide bandwidth, circularly polarized microstrip antennas", IEE Proceedings vol. 136 Pt H No. 5 Oct. 1989 p. 381-389.

Jui-Han Lu et al; "Compact circular polarization desing for equilateral-triangular microstrip antenna with spur lines" Electronics Letters Oct. 15, 1998, vol. 34 No. 21 p. 1989-1990.

* cited by examiner

PATCH ANTENNA

TECHNICAL FIELD

The present invention relates to microwave antennas, and more particularly to a hexagonal micro-strip patch design of an electrically scanned antenna array (ESA) providing polarisation diversity.

BACKGROUND

Balanced, probe-fed, micro-strip patches have good broadband properties when operated in antenna arrays. Such elements 1 require two probes per polarisation, implying four probes 3 for a doubly polarised element, also see FIGS. 1*a* and 1*b* defining prior art.

Self-complementary antenna elements are known to possess a fix input impedance (half the intrinsic impedance of space, $Z_0/2 \approx 188.5$ ohms) over a wide bandwidth. The theory of the self-complementary antenna was established already 1949 by the Japanese Professor Mushiake.

Micro-strip patch technology offers the possibility of fabricating a large number of antenna elements in one, cheap process step with small tolerances. Antenna arrays in triangular, or rather, hexagonal grids are considered optimal since they offer efficient packaging and avoid grating lobes.

Balanced probe fed micro-strip patch antennas previously have been realised with two probes per polarisation as illustrated in FIG. 1. For instance the U.S. Pat. No. 6,597,316 B2 discloses a spatial null steering micro-strip antenna array where each antenna element is appropriately excited by symmetrically spaced probes. Another U.S. Pat. No. 5,229,777 discloses a micro-strip antenna having a pair of identical triangular patches maintained upon a ground plane, with feed pins being connected to conductive planes of the triangular patches at apexes maintained in juxtapositions to each other. The input signals to the pair of patches are of equal amplitude, but 180° out of phase.

The authors presume that also three-phase feeding would have been generally proposed in the literature. An equidistant phase (120 degrees) between such probes yields so-called circular polarisation.

Self-complementary antennas are currently considered for broadband systems. Most often realised in micro-strip technology, their conducting topology is identical with its non-conductive if mirrored, translated and/or rotated. The advantages of micro-strip patch antenna arrays are well known, so are those of hexagonal arrays.

However a micro-strip patch design of a self-complementary probe-fed antenna element in a hexagonal array configuration transmitting/receiving arbitrarily polarised RF radiation with co-located phase centres of each polarisation has not been disclosed previously. Hence the defined problem is then solved by the present invention.

SUMMARY OF THE INVENTION

A method for forming a self-complementary patch antenna and a self-complementary patch antenna is disclosed. A hexagonal lattice consisting of triangular conducting patches is formed together with at least one dielectric layer onto a ground-plane. Each triangular patch is then fed by means of three RF signal probes in a symmetrical configuration positioned near each corner of the triangle, whereby an arbitrary lobe-steering and polarisation state can be established by selection of amplitude and phase for each RF signal probe. In a typical embodiment the triangular conducting patches are shaped as equilateral triangles, whereby electrical properties of the RF signal probes can be controlled by one parameter being the distance between probe/patch joint and the patch corner and further parameters of the conducting patches are controlled by means of another parameter being the height of the patch above the ground-plane and its dielectric layer(s).

SHORT DESCRIPTION OF THE DRAWINGS

The invention together with further objects and advantages thereof, may be best understood by making reference to the following description taken together with the accompanying drawings, in which:

FIG. 1*a* demonstrates a basic micro-strip patch antenna element seen from the side;

FIG. 1*b* illustrates a typical micro-strip patch element fed by two pairs of probes;

Figure 4A:
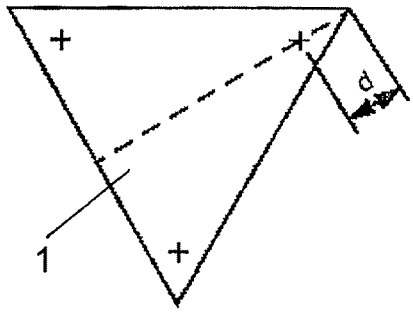
Figure 4B:
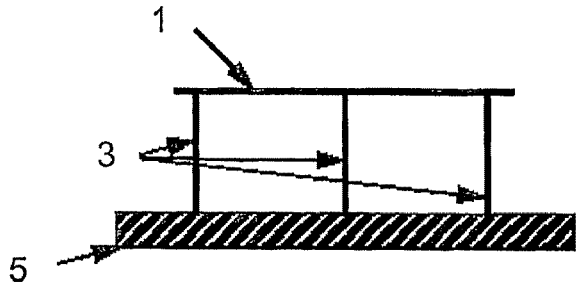
Figure 5:
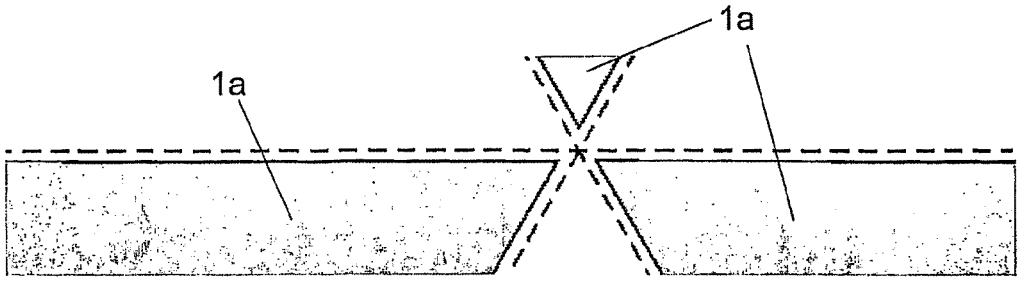
Figure 6:
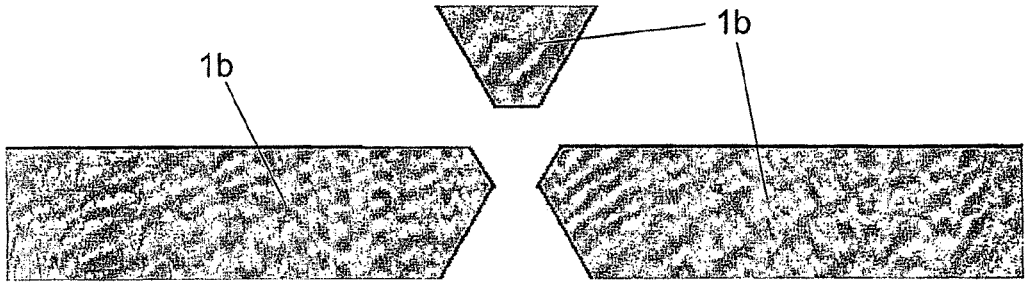

FIG. 4*a* illustrates in a top view, a probe geometry in accordance with the present invention;

FIG. 4*b* illustrates in principle in a side view the probe arrangement in accordance with the present invention;

FIG. 5 illustrates a reduced size (shaded) compared to the ideal, self-complementary shape (dashed); and FIG. 6 illustrates a modification of the self-complementary-shaped patch corners.

DETAILED DESCRIPTION

Figure 2:
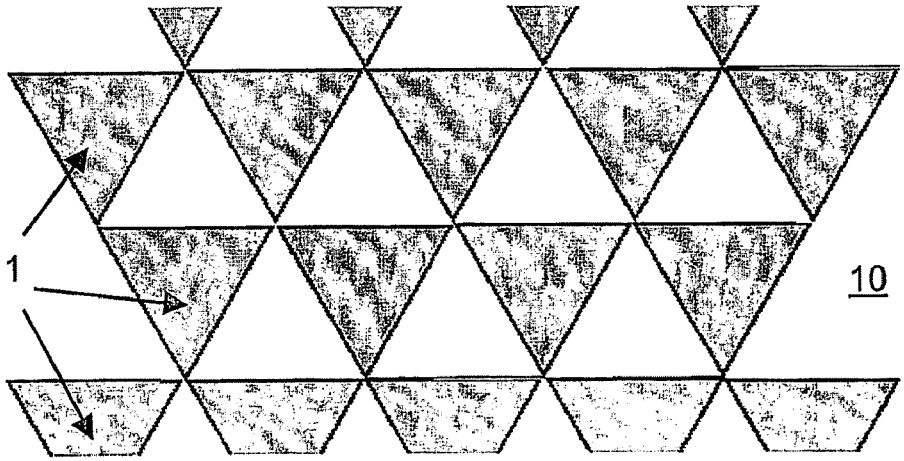
FIG. 2 illustrates the geometry of conducting patches in a triangular lattice patch layer utilised in the present invention.
Figure 3:
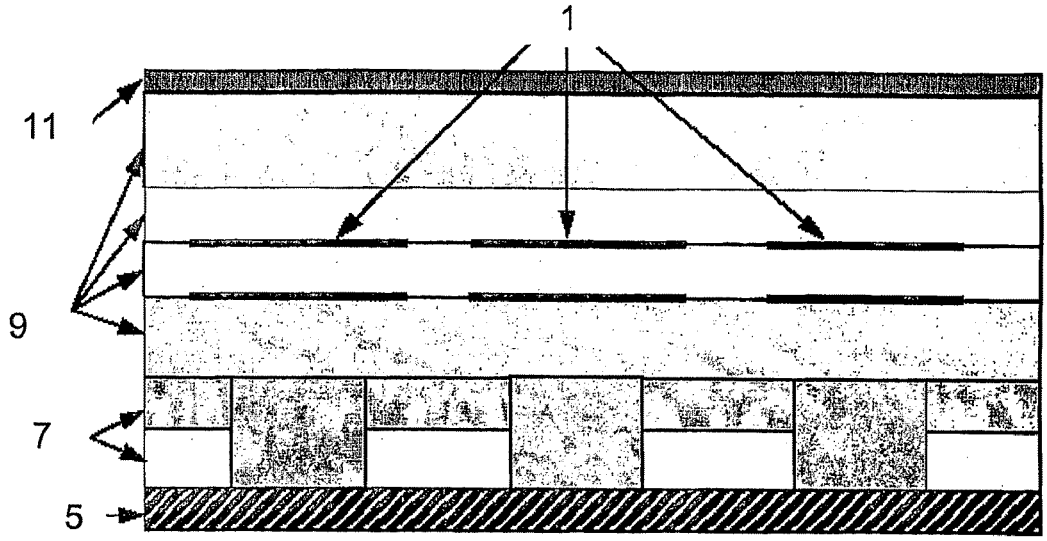
FIG. 3 is an example of a dielectric layer configuration.

In FIG. 2 a portion is sketched of a patch layer 10 consisting of triangular conducting patches 1 onto a printed circuit board (PCB) laminate. In a preferred embodiment the triangular conducting surfaces of the created pattern consist of equilateral triangles. A number of dielectric layers 7, 9 and an outer skin 11 support the patch layer, both from an electrical point of view and a mechanical point of view as illustrated in FIG. 3. Reference number 5 illustrates an expected Perfect Electrical Conductor (PEC) in this arrangement.

Note that the layers can be uniform, i.e. with constant material parameters along the layers, as well as being non-uniform, i.e. with varying material parameters along the layers.

Figure 1A:
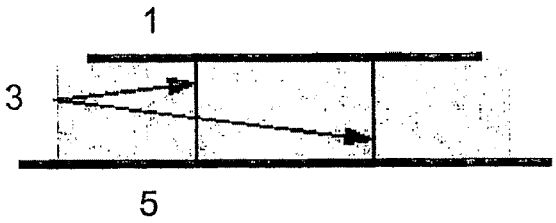
Fig. 1a (Prior Art)
Figure 1B:
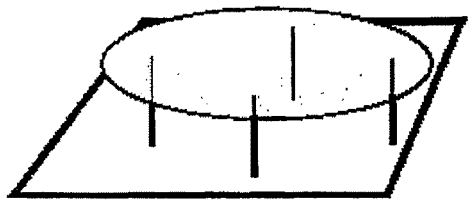
Fig. 1b (Prior Art)

Each patch 1 is fed by three probes 3 in a symmetrical configuration as illustrated in FIG. 4. This makes it possible to choose an arbitrary polarisation state with only three probes per patch, instead of the usual four as compared to FIG. 1*b*.

The electrical properties of the RF probes can be controlled by a parameter, d, the distance to corner (apex) of the triangular patch and the probe/patch joint.

Another fundamental distance is the height, h, of the patch layer 1 above the PEC ground plane 5. Remaining control parameters are the dielectric constants, including dielectric and/or conductive losses of the layers.

If the patch layer is truly self-similar, a troublesome situation might occur at the patch corners (apexes), with a non-definable conductivity as a result. This problem can be solved by either reducing the size of the metal triangles 1*a* according to FIG. 5 or by shaping their corners of their surfaces 1*b* according to FIG. 6.

The excitation can be established using different principles, of which two will be illustrated below:

Principle 1: If one point for each patch in the lattice is determined, e.g. the patch centre, a prescribed excitation over the antenna aperture at this point may be sampled. This means that one excitation—phase and amplitude—can be associated with each patch. If the polarisation thereafter is chosen, it is possible to calculate the resulting voltage and phase that should be induced at all three probes in order to realise the chosen excitation and polarisation.

Principle 2: The three closely adjacent probes at a three-patch junction may be viewed as a tripole antenna element, amplitude, lobe-steering phase and polarisation determine the complex voltages on each of the three probes.

ADVANTAGES OF THE INVENTION

The present invention designates a low cost fabrication techniques to peak-performance electrically scanned antenna arrays (ESA). Low cost because of cheap materials, fewer feed points per patch and efficient PCB mass production techniques. High performance is obtained because of broad-band capacity, polarisation diversity, high polarisation quality and low PCB process tolerances.

It will be understood by those skilled in the art that various modifications and changes could be made to the present invention without departure from the spirit and scope thereof, which is defined by the appended claims.

The invention claimed is:

1. A method for forming a self-complementary patch antenna, comprising the steps of:

forming a hexagonal lattice consisting of triangular conducting patches formed together with at least one dielectric layer onto a ground-plane; and, providing each triangular patch with three RF signal probes in a symmetrical configuration at each apex of each said triangular conducting patch, wherein an arbitrary lobe-steering and polarisation state can be established by selection of amplitude and phase for each RF signal probe.

2. The method according to claim 1, further comprising the step of:

shaping the triangular conducting patches as equilateral triangles, wherein electrical properties of the RF signal probes can be controlled by varying the distance between each probe/patch joint and each patch corner.

3. The method according to claim 1, further comprising the step of:

controlling further parameters of the conducting patches by varying the height of each patch above the ground-plane and its dielectric layer(s).

4. The method according to claim 1, further comprising the step of:

shaping each corner of each triangular conducting patch by slightly cutting their apexes to avoid any contact between patches.

5. The method according to claim 1, further comprising the step of:

reducing size along all three sides of each triangular conducting patch by a small amount to avoid any contact between patches.

6. A self-complementary patch antenna, comprising:

a hexagonal lattice consisting of triangular conducting patches together with at least one dielectric layer onto a ground-plane;

wherein each triangular patch is fed by three RF signal probes in a symmetrical configuration at a distance from each apex of the triangular patch, whereby an arbitrary lobe-steering and polarisation state is established by a selection of amplitude and phase for each RF signal probe.

7. The self-complementary patch antenna according to claim 6, wherein the triangular conducting patches are shaped as equilateral triangles, whereby electrical properties of the RF signal probes is controlled by a parameter being distance between probe/patch joint and patch corner.

8. The self-complementary patch antenna according to claim 6, wherein further parameters of the conducting patches are controlled by means of a parameter being a height of the patch above the ground- plane and its dielectric layer(s).

9. The self-complementary patch antenna according to claim 6, wherein each corner of each triangular conducting patch is shaped by a slight cutting of their three corners to thereby avoid any contact between patches.

10. The self-complementary patch antenna according to claim 6, wherein a size of each triangular conducting patch is reduced by a small amount along all its three sides to avoid any contact between patches.

* * * * *